United States Patent [19]

Gregorian et al.

[11] 4,365,968

[45] Dec. 28, 1982

[54] METHOD OF TREATING TEXTILE MATERIALS

[75] Inventors: Razmic S. Gregorian, Aiken; Chettoor G. Namboodri; John D. Johnson, both of North Augusta, all of S.C.

[73] Assignee: United Merchants & Manufacturers, Inc., New York, N.Y.

[21] Appl. No.: 241,335

[22] Filed: Mar. 6, 1981

Related U.S. Application Data

[63] Continuation of Ser. No. 943,829, Sep. 19, 1978, abandoned.

[51] Int. Cl.[3] ..... B41M 1/10; D06M 1/00; D06M 13/34

[52] U.S. Cl. ..... 8/477; 8/149.1; 8/495; 8/505; 8/929; 427/244; 427/258; 427/288; 427/350; 427/373; 427/393.2

[58] Field of Search ..... 8/477, 495, 496, 149.1, 8/505, 929; 427/244, 258, 288, 350, 373, 393.2, 393.3, 393.4

[56] References Cited

U.S. PATENT DOCUMENTS

| | | | |
|---|---|---|---|
| 3,042,573 | 7/1962 | Roberts | 156/285 |
| 3,934,971 | 1/1976 | Blanchard et al. | 8/14 |
| 3,945,791 | 3/1976 | Bohrn | 8/17 |
| 4,099,913 | 7/1978 | Walter et al. | 8/173 |
| 4,118,526 | 10/1978 | Gregoran et al. | 427/350 |

FOREIGN PATENT DOCUMENTS

| | | | |
|---|---|---|---|
| 2304104 | 1/1974 | Fed. Rep. of Germany | 8/1 X |
| 1157737 | of 1909 | United Kingdom | 8/1 X |

OTHER PUBLICATIONS

Fox, Maurice R. et al., *Possibilities of Vacuum Technology*, pp. 1-13, Dec. 1973.

*Primary Examiner*—Michael R. Lusignan
*Attorney, Agent, or Firm*—Kenyon & Kenyon

[57] ABSTRACT

Disclosed herein is a process for treating textile materials with finishing agents wherein a first finishing agent-containing composition is applied to a textile material and a second composition, in the form of a foam, is thereafter applied to the textile prior to fixation of the the first applied composition. The first composition may also be applied in the form of a foam if desired. The compositions may also contain reactive materials therein.

17 Claims, 2 Drawing Figures

METHOD OF TREATING TEXTILE MATERIALS

This is a continuation of application Ser. No. 943,829, filed Sept. 19, 1978, now abandoned.

BACKGROUND OF THE INVENTION

This invention relates to textile materials and, more particularly, to the application of finishing agents to textile materials.

Conventionally, the treating of textile materials with finishing agents, e.g., coloring agents or dyes, resins, softeners, flame retardent agents, soil release agents and the like involves a procedure wherein the finishing agent is either dissolved or dispersed in a suitable liquid medium carrier such as an aqueous or organic liquid, and then applied to the textile, such as by passing the textile through a bath or vat containing the solution or dispersion. Thereafter, the carrier is removed from the fabric, usually by evaporation with or without heat. Since only a small amount of the finishing agent is needed to achieve the desired effect, a relatively large amount of carrier (water) is used to assure uniform distribution of the finishing agent. This results in relatively large amounts of liquid medium which must be removed from the fabric. Consequently, a substantial amount of the cost incurred in such processes resides in the liquid medium removal step.

For many textiles it is desired to apply more than one finishing agent thereto. For example, it may be desirable to first dye the textile and then apply a durable press agent or to apply both durable press and soil release agents to the textile. Since relatively few of such combinations of finishing agents can be applied together friom the same medium, such multiple agents are typically applied to the textile in a serial manner. Thus, for example, a coloring agent is first applied to the textile; the textile is then dried; and the colored textile then treated with a further fabric finishing agent in a conventional manner and then re-dried.

In the foregoing process, the disadvantages earlier described as being associated with the conventional utilization or large quantities of liquid medium in the application of finishing agents are necessarily multiplied. In an effort to avoid the difficulties involved with large amounts of liquid and the high cost of liquid removal processes, it has been attempted to conduct the serial application of finishing agents to a textile without intermediate drying of the textile after each application. However, this manner of operation itself leads to serious problems. Thus, when the wet textile to which a first finishing agent solution or dispersion has been applied is brought into contact with a second liquid finishing agent composition, e.g., when the wet textile is passed through a bath thereof, the liquid associated with the textile from the first application serves to dilute or otherwise alter the composition of the second finishing agent solution or dispersion. It is thereby nearly impossible to accurately control the application of specified quantities of the second finishing agent to the textile, even with the utilization of complicated measuring devices and bath replenishment techniques.

SUMMARY OF THE INVENTION

It is accordingly an object of the present invention to provide a process for treating a textile with more than one finishing agent.

A further object of the present invention is to provide a serial process for treating a textile with at least one finishing agent which does not require intermediate fixation of the textile prior to application of a foam composition thereover.

A still further object of the present invention is to provide a process of the type mentioned which does not present difficulties in the control of the amounts of finishing agent applied to the textile.

These and other objects are achieved by the provision of a process wherein a textile is first treated with a finishing agent-containing composition and, prior to any significant drying or fixation (i.e., complete removal of all liquid therefrom), is thereafter treated with a second covering composition which is applied in the form of a foam. The textile is then treated to collapse the foamed composition and effect uniform penetration of the finishing agent into the fabric, if desired.

The treatment of textiles in accordance with the present invention has the advantage of eliminating costly liquid removal procedures between application of finishing agents. Moreover, it has been found that application of the second finishing agent in the subsequently applied foamed composition avoids the earlier-referred to dilution effect arising from conventional application of the second finishing agent in a liquid solution or suspension since significantly less liquid per se is required when such compositions are applied as foams, and since the foam can be applied without the need for passing the textile through a bath or vat containing the liquid finishing agent composition.

In accordance with the present invention, the application of the first finishing agent-containing composition to the textile can be accomplished in accordance with conventional techniques, e.g., by continuously passing the textile through a bath or vat containing the liquid composition. However, according to a preferred embodiment of this invention, the first finishing agent composition may be applied in the form of a foam. In this method of operation, this first foam applied to the textile is collapsed, prior to application of the second foamed composition to the textile. Such collapsing of the first applied foam may occur upon application such as when using rotary screen printers and the like.

Finishing agent-containing compositions for utilization in the present invention are known in the art and typically comprise a finishing agent and an aqueous or organic liquid carrier medium along with other known, optional ingredients.

For the case where the finishing agent-containing composition is applied as a foam, the preparation and formulation of such foamed compositions is described in the commonly-assigned application of Gregorian and Namboodri, Ser. No. 584,389, now U.S. Pat. No. 4,118,526, patented Oct. 3, 1978, incorporated herein by reference. These foamed compositions are prepared by foaming a mixture comprised of finishing agent, liquid medium and a foaming agent (foam stabilizer) to a blow ratio of from about 2:1 to about 20:1 to result in a foamed composition having a foam density in the range of from about 0.5 gm/cc to about 0.05 gm/cc.

The various finishing agents which may be utilized in the treatment of textiles according to the present invention include coloring agents, dyes, pigments, durable press agents, soil release agents, weighting agents, flame retardants, water repellents, softeners, and the like. Foamable, liquid compositions containing such finishing agents, and methods of preparing foams therefrom, are extensively described in detail in the above-mentioned application Ser. No. 584,389.

In specific embodiments of the present invention, the application of the first finishing agent-containing composition may comprise printing the textile with a preselected pattern in accordance with known procedures, e.g., by use of an intaglio printing cylinder of a rotary screen printer. The first composition may be a conventional liquid printing composition, a foamed printing composition or a powdered composition. After application, a foamed composition, with another finishing agent, is applied to the textile prior to fixation of the first applied finishing agent to the printed textile.

The process of the present invention will typically be utilized for the serial application of two or more differing types of finishing agents to a textile, e.g., a colorant and a water-repellent or a colorant and a durable press agent, although numerous other combinations exist.

As utilized herein, textile material is intended to include, without limitation, fabrics made from threads, yarns, woven or knitted goods, resin bonded mats of fibers, and the like.

According to this invention, the second, serially applied fabric finishing agent is applied to the textile in the form of a foam while the textile still contains a first finishing agent-containing composition (either foam, liquid or powder). Thus, as utilized herein, application of the second composition without prior fixation of the textile is intended to describe and embrace processes wherein the textile has not been fully dried after application of the first composition. Hence, it is possible according to this invention that varying degrees of liquid removal, short of complete or near-complete drying, from the textile can be performed before application of the second, foamed composition, although the economic advantages of the present invention necessarily decrease in proportion to the degree of such an intermediate liquid removal step. Moreover, a certain degree of liquid removal from the textile may occur simply as a result of normal processing prior to application of the second, foamed composition. For example, some liquid may be removed by virtue of passage of the textile through conventional squeeze rolls prior to passing to the second serial application step. In the case of foam printing, the generally preferred manner of collapsing the foam is accomplished by the printing screen or print roller at the instant the foam is applied to the fabric.

In general, the textile to which the second finishing agent composition is applied will have about 10 to 65% liquid, by weight, associated therewith.

DESCRIPTION OF THE PREFERRED EMBODIMENTS

The present invention is more fully described with reference to the description of the drawings and the Examples which follow.

Figure 1:
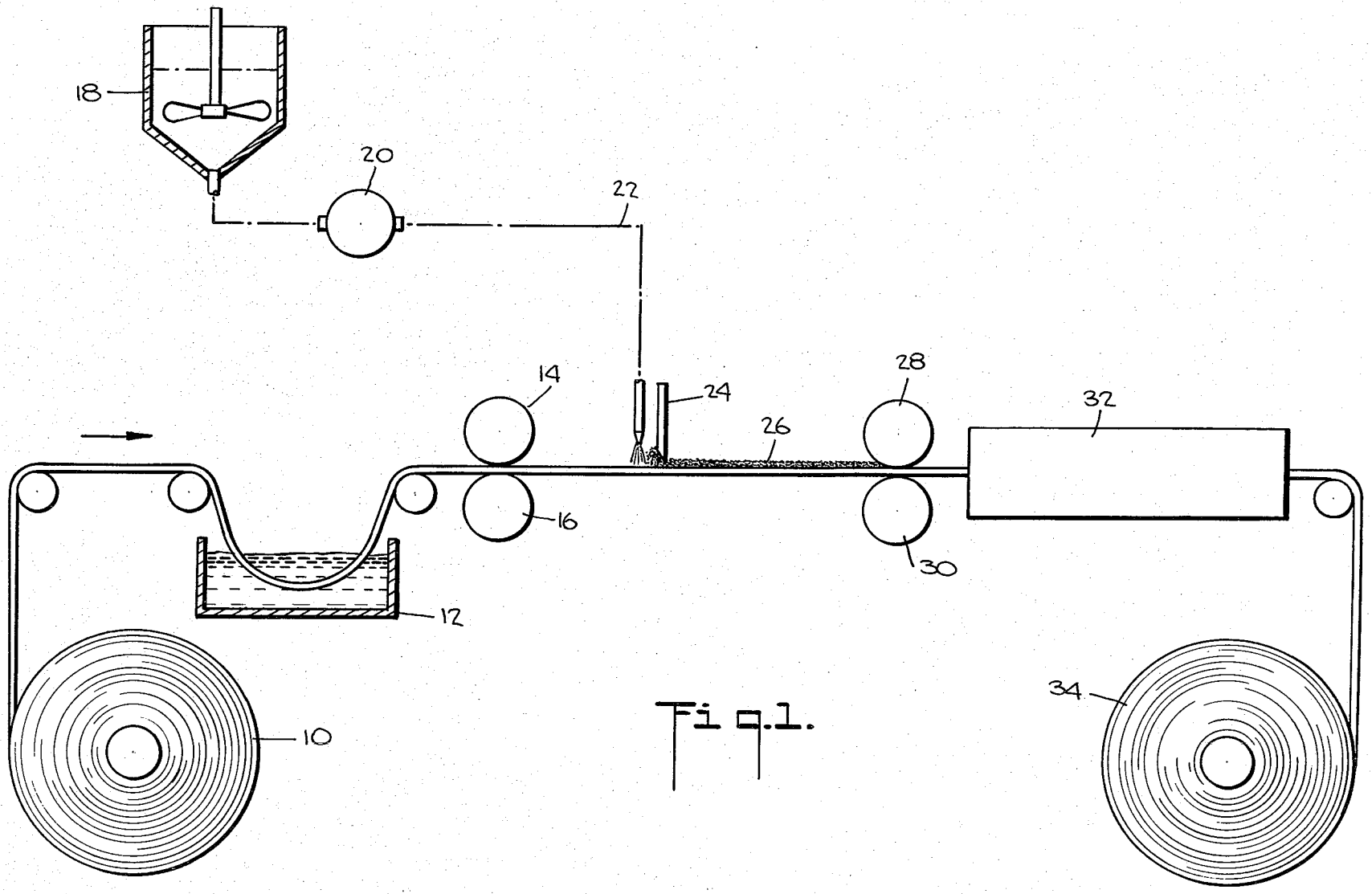
FIG. 1 is as schematic representation of an embodiment depicting the process of the present invention wherein the first liquid and finishing agent-containing composition is applied as a solution or dispersion.

With reference to FIG. 1, a roll of fabric 10, travelling in the direction indicated by the arrow, is passed by suitable conveying means to a bath 12 containing a pre-prepared liquid, e.g., aqueous or organic liquid, solution or dispersion containing an appropriate finishing agent, e.g., a dye material to color the fabric. The dyed fabric is then passed through squeeze or compression rollers 14 and 16 which serve to remove some of the liquid contained in the fabric by virtue of its passage through the solution or dispersion. Without any further liquid removal, i.e., before complete drying, the dyed fabric is coated with a foamed finishing agent composition. Thus, a foamable liquid composition comprised of liquid, foaming agent and finishing agent, e.g. a durable press agent, is formed into a foam in foamer 18. Foamer 18 may be any type foaming device conventionally utilized in the art, e.g., Oakes, Godwin card, Kitchenaid, etc.

The foamed composition is transferred through line 22 by pump 20 to knife 24. At this point the foamed composition is coated onto the dyed fabric to produce a coated fabric 26. The coated fabric 26 then goes through nip rollers 28 and 30 to compress and collapse the foam and achieve penetration of finishing agent into the fabric. Such foam collapse may also be achieved by the application of vacuum, or a combination of vacuum and padding. Thereafter, the impregnated fabric is conveyed through a fixation means 32 which may be any of those conventionally known in the art. The fixed fabric is then wound on to take-up roll 34.

Figure 2:
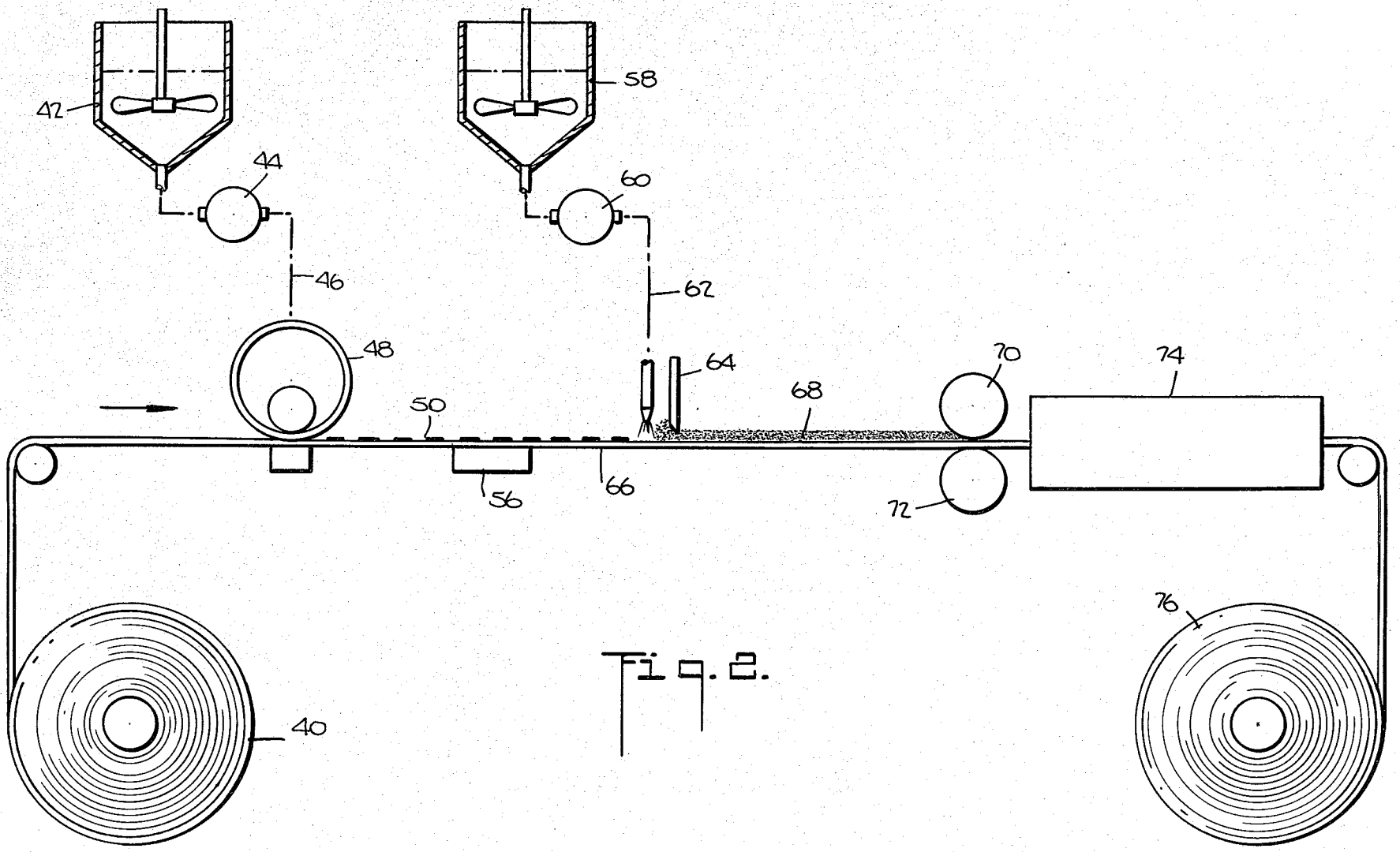
FIG. 2 is a schematic representation of an embodiment of the present invention wherein the first finishing agent-containing composition is applied in the form of a foam.

An alternative embodiment of the process of the present invention is shown in FIG. 2. A roll of fabric 40, travelling in the direction of the arrow by suitable conveying means, is coated with a first foamed fabric finishing agent composition. Such a foamed composition is prepared by foaming a suitable composition, e.g., a dye-containing foamable composition, in foamer 42. The foamed composition is pumped by pump 44 through line 46 to a rotary printing screen 48 at which a predetermined pattern is applied to the fabric. As mentioned previously, with such a printing screen, the foam is caused to collapse upon application. If a procedure is employed in which the foam is not collapsed upon application, the so-coated fabric 50 is then passed over vacuum or padding device 56 or a combination of the two which serves to collapse the foam but which does not effect liquid removal from the fabric.

The so-treated fabric 66 is then coated with a second foamed finishing agent composition, formed by foaming a suitable composition, e.g., a durable press-containing foamable composition, in foamer 58. The second foamed composition is transferred by pump 60 through line 62 to knife 64 where it is coated on the fabric. The so-coated fabric 68 then passes through nip rollers 70 and 72 to collapse the foam and deeply penetrate the finishing agent into the fabric. The fabric is then conveyed to a fixation means 74 and wound on take-up roll 76.

In the foregoing embodiments, the foamed finishing agent composition may also be applied by spraying or blowing it through a nozzle onto the fabric.

The following Examples illustrated various specific features of the process of the present invention.

EXAMPLE I

A foamable pigment composition containing 70.86% water, 2.07% ammonium stearate, 0.78% lauryl alcohol, 4.29% Acrysol ASE-60 (an acrylic polymer emulsion having 28% solids (Rohm & Haas Co.)), 2% Valmel-45 (a methylolated melamine), 10% Valbond-6063 (an acrylic copolymer emulsion) and 10% Questral Blue 3G (phthalocyanine pigment) was foamed to a 3:1 blow ratio and printed through a 50 mesh rotary screen on 100% cotton print cloth and 50/50 polyester/cotton blend sheeting samples. The printing foam was collapsed by the action of the screen upon application of the foam to the fabric.

A foamable durable press resin composition was prepared containing 52.10% water, 0.62% Methocel J-75MS (an etherified hydroxyethyl cellulose), 1.37% Unamide N-72-3 (a coconut alkanolamide from Lonza Chem. Co.), 36.16% Valrez-248 (a modified glyoxal resin) and 9.8% Valcat No. 7 (a magnesium chloride catalyst). This composition was foamed to a blow ratio of 9:1 and knife coated to a thickness of 6 mils on the wet printed samples previously prepared as described above. The fabric samples were then vacuumed, dried and cured at 350° F.

The definition of the prints was excellent and the fabrics possessed durable press properties tested after repeated laundering.

As a control, a sample of the previously described foam printed 100% cotton was passed through a conventional finishing bath of Valrez-248 and Valcat No. 7 and nipped through a vertical pad. The fabric was dried and cured as before.

The print exhibited severe flushing and loss of definition so as to make the fabric commercially unacceptable. There was also some transfer of color to the pad bath.

EXAMPLE II

The foamable durable press resin composition described in Example I was foamed to a blow ratio of 8:1 and knife-coated to a thickness of 6 mils onto 100% cotton and 50/50 polyester/cotton blend fabrics. The fabrics were vacuumed and, while wet, were printed utilizing the foamed pigment composition and conditions described in Example I.

Good print definitions and durable press properties were obtained.

EXAMPLE III

A foamable composition containing 2% Resolin Blue FBL (disperse), 1% Procion blue HA (reactive), 1% sodium bicarbonate and 96% of a foamable composition containing 97.75% water, 0.75% QP-52000 (hydroxethyl cellulose thickener from Union Carbide) and 1.5% Unamide N-72-3 was prepared and foamed to a blow ratio of 10:1.

A second durable press resin composition containing 50.75% water, 0.75% QP-52,000, 35% Valrez-248, 3% Valsof PE-19 (a polyethylene emulsion), 1% Unamide N-72-3 and 9.5% Valcat No. 7 was foamed to a blow ratio of 10:1.

On a 65/35 polyester/cotton blend fabric, the dye foam was coated to a thickness of 20 mils and the coated fabric pulled over a vacuum (wet pick-up 45%). On the dye-applied wet fabric, the durable press foam composition was knife-coated to a thickness of 25 mils. The fabric was then vacuumed (total wet pick-up 62%), and dried and cured at 330° F. for 3 minutes.

The fabric contained good durable press properties and was uniformly dyed.

A sample of the wet foam dyed fabric was also passed through a conventional finishing bath consisting of Valrez-248, Valsof PE-19 and Valcat No. 7 in the same ratio as the foam finishing composition but at an 8% solids concentration. There was significant bleeding of color into the pad bath causing the fabric to be off-shade.

EXAMPLE IV

A sample of 65/35 polyester/cotton blend was dyed, using the beck dyeing procedure, with 1% Sirius Supra Blue BRL (direct dye) and 2% Resolin Blue FBL (disperse) based on the weight of the fabric. After the dyeing cycle, the fabric was rinsed, padded and vacuumed.

The durable press resin composition of Example III was foamed to a blow ratio of 10:1 coated to a thickness of 25 mils onto the wet beck-dyed fabric. The fabric was then padded at 35 p.s.i.g., dried at 220° F. and cured at 330° F. for 3 minutes.

The fabric possessed durable press properties and was uniformly dyed.

As a control, a sample of the wet dyed fabric was passed through a conventional finishing bath of the composition described in Example III. Again there was bleeding of the color from the fabric into the pad bath.

EXAMPLE V

A foamable disperse dye composition containing 2% Resolin Brill. Yellow 7 GL in 98% of a composition containing 0.75% QP-52000, 1.5% Unamide N-72-3 and 97.75% water (adjusted to a pH of 5.5 with acetic acid) was prepared and foamed to a blow ratio of 8:1. This foamed composition was then knife coated to a thickness of 35 mils on a polyester double knit fabric. The fabric was then passed over a vacuum slot.

A second foamable composition containing 2% Resolin Red FB (Disperse Red-60) in 98% of a composition containing 0.75% QP-52000, 1.5% Unamide N-72-3, and 97.75% water (adjusted to pH 5.5) is foamed to a blow ratio of 3:1 and over printed through a 50 mesh rotary screen printer on the wet foam-dye applied polyester knit. The knit fabric is then dried and thermosoled at 350° F. for color fixation to produce special over printing effects.

EXAMPLE VI

A foamable composition containing 4 parts Rapidogen Red KB, 1 part caustic (50% soln.) and 95 parts of an alkaline foamable composition containing 3.5% 309-70 acrylic, 90.5% water, 0.5% ammonia and 5.5% 309-59 ammonium stearate (20% soln.) was foamed to a blow ratio of 8:1 and knife coated to a thickness of 25 mils on a cotton sheeting sample. The coated sample was then padded at 30 p.s.i.g. (wet pick-up 40%). A second sample was foam printed through a 50 mesh rotary screen printer with the same foam.

An acid color developing foam was prepared by dissolving 2 parts acetic acid and 2 parts formic acid in 96 parts of a foamable composition containing 1.5 parts Unamide N-72-3, 0.75 parts of QP-52,000 and 97.75 parts water, and foaming to a 10:1 blow ratio. This foamed composition was coated to a thickness of 25 mils onto each of the above-referred to wet samples. The samples were then vacuumed from the back to collapse the foam and then steamed at 210° F. to remove acid vapor and water. The color was developed and demonstrated good fixation. The printed fabric has excellent definition.

When the printed wet samples were developed by conventional padding through a formic/acetic acid mixture, there was color bleeding and the resulting prints had flushing.

EXAMPLE VII

A foamable prewetting composition containing 0.5 parts Valdet-4016 and 94.5 parts water was prepared. The composition was foamed to a 10:1 blow ratio and 25 mils of foam was coated on a cotton velour upholstery material and padded. On the prewetted material direct dye foam was applied as follows:

A dye composition containing 1 part direct dye-Sirius Supra Blue 2RL and 99 parts of a mix containing 3.5% Valthick-70, 0.5% aqua ammonia, 90.5% water and 5.5% Am. stearate (20%) was foamed to 6:1 blow ratio. Then 50 mils of the foam was coated wet-on-wet on the foam prewetted sample and the so treated sample was vacuumed and padded. The sample was then steamed for 7 minutes at 210° F. and dried at 220° F.

Uniform dyeings were obtained on the cotton fabric having good color fasteners.

EXAMPLE VIII

A 10% solution of procion Red MX 5B reactive dye in water was prepared. The dye solution was applied to a cotton carpet pile in a random pattern.

An alkaline composition containing 2 parts sodium hydroxide (50% soln.) and 98 parts of a mix containing 3.5% Valthic-70 (an acrylic acid polymer emulsion), 0.5% ammonia, 90.5% water and 5.5% Am. stearate (20%) was prepared. This composition was foamed to a 6:1 blow ratio and 50 mils of foam was knife coated on the aforementioned carpet pile having reactive dye applied. The carpet was vacuumed from the back side and padded. Then for reactive dye fixation, the sample was wet stored for 4 hrs. and dried at 220° F. The randomly applied color had good penetration inside pile.

EXAMPLE IX

A foamable composition consisting of 3.5 parts of Valthick-70 (an acrylic acid emulsion polymer), 0.5 parts of aqua ammonia 5.5 parts of a 20% solution of ammonium stearate and 90.5 parts of water was prepared.

To 95 parts of this foamable composition was added 3 parts Naphthol AS (C.I. Axoic Coupling component 2) and 2 parts of 50% sodium hydroxide. This mixture was mechanically foamed to an 8 to 1 blow ratio and knife coated onto cotton print cloth to a thickness of 10 mils. the fabric was then padded at 30 psi.

A second foamable composition consisting of 1.5 parts of Valdet CC (a fatty acid diethanolamide manufactured by Valchem) 0.75 parts of Cellosize QP 52,000 (a hydroxyethyl) cellulose manufactured by Union Carbide) and 97.75 parts of water was prepared.

To 90 parts of this second foamable composition was added 8 parts of Fast Scarlet 2G salt (C.I. Azoic Diazo Component 3) and 2 parts of acetic acid. The composition was mechanically foamed to an 8 to 1 blow ratio and a 10 mil coating was applied to the wet fabric samples previously coated within the first composition. The sample was padded at 30 psi. and exposed to air for 3 minutes.

The fabric was then dried. The dried fabric was soaped to remove the uncoupled components. Good color development was achieved.

EXAMPLE X

A first foamable composition consisting of 3.5 parts of Acrysol ASE-60 (an acrylic acid emulsion polymer manufactured by Rohm and Haas), 0.5 parts of aqua ammonia, 5.8 parts of a 20% solution of ammonium stearate and 90.2 parts of water was prepared.

To 100 parts of the foamable composition was added 6 parts of Sodyesul Liquid Blue 4BGCF (C.I. Leuco Sulfur Blue 13) and 6 parts of Sodified B (a solution of sodium sulfide manufactured by Southern Dyestuff Company) and 3 parts of soda ash.

The composition was mechanically foamed to a 6 to 1 blow ratio. Fifty mils of the foamed composition was then knife coated onto a cotton corduroy fabric. The coated fabric was passed over a vacuum slot and then padded at 30 psi.

A second fabric sample was coated with 25 mils of the foamed composition and padded only.

Both samples were steamed at 210° F. for 5 minutes.

A foamable oxidizing composition consisting of 1 part of Valdet CC, 1 part of acetic acid, 1 part of 35% hydrogen peroxide solution and 97 parts of water was prepared.

This composition was foamed to a 10 to 1 blow ratio and 200 mils of the foam was knife coated onto the previously wet steamed samples. The thus coated fabric samples were passed over a vacuum slot to draw the foam into the fabric. The dye was oxidized.

The samples were then dried. The sulfur dyed cotton corduroys possessed level dyeing and good color fastness properties.

EXAMPLE XI

A foamable vat pigment composition consisting of 96 parts of the first foamable composition described in Example X and 4 parts of Vat Yellow 4 paste (manufactured by Ciba Geigy) was prepared.

The composition was foamed to an 8 to 1 blow ratio and then knife coated to a thickness of 25 mils onto cotton sheeting. The coated fabric was then padded and dried.

A second foamable reducing composition was prepared from 5 parts of 50% sodium hydroxide solution, 3 parts of sodium hydrosulfite, 2 parts of Valdet CC and 90 parts of water. This composition was then mechanically foamed to an 8 to 1 blow ratio and a 100 mil coating applied to the previous vat pigment coated fabric. The fabric was then passed over a vacuum slot and steamed at 210° F. for 5 minutes for reduction of vat pigment.

The wet steamed fabric was then oxidized to develop and fix the color by applying the foamed oxidizing composition previously described in Example X. The fabric ws then dried. A level dyeing with good fastness properties was obtained.

What is claimed is:

1. A process of treating textile materials which comprises the steps of:

(a) applying a first finishing agent-containing composition to a textile material;

(b) thereafter coating said textile material containing said first composition with a second composition in the form of a foam, said second composition being coated over said first finishing agent-containing composition prior to fixation of said first composition;

(c) collapsing the subsequently applied foamed composition so as to force said first finishing agent-containing composition into said textile; and (d) thereafter fixing said finishing agent to said textile material.

2. The process according to claim 1 wherein said first finishing agent-containing composition is in a liquid form and is applied to the textile material in the form of a foam and wherein said foam is collapsed prior to application of said later applied second foam composition, said textile material having approximately 10 to 65% liquid by weight prior to application of said second foam composition.

3. The process according to claim 1 wherein said finishing agent is selected from the group consisting of coloring materials, durable press agents, water repellent agents, soil release agents, softeners, weighting agents and fire retardant agents.

4. The process according to claim 3 wherein said finishing agent in said first composition comprises a coloring material.

5. The process according to claim 1 wherein said collapsing step causes the foamed composition to penetrate substantially the entire thickness of said textile material.

6. The process according to claim 2 wherein said second composition includes therein a finishing agent.

7. The process according to claim 2 wherein both said first and second compositions are foamed compositions applied to said textile material by knife-coating said compositions onto said textile material.

8. The process according to claim 2 wherein application of said first finishing agent composition includes applying a foamed composition including therein a coloring material to be applied onto the textile material in a pre-selected pattern.

9. The process according to claim 1 wherein application of said first finishing agent containing composition comprises applying a powdered finishing agent onto the textile material.

10. The process according to claim 2 wherein collapse of said second foam composition is achieved by application of a vacuum, padding or a combination of vacuum and padding.

11. The process according to claim 1 wherein said second foamed composition includes an aqueous finishing agent and is prepared by forming a mixture comprised of liquid medium, finishing agent and foaming agent, and foaming the mixture to a blow ratio in the range of from about 2:1 to about 20:1 to produce a foam having a foam density in the range of from about 0.5 gm/cc to about 0.05 gm/cc.

12. The process according to claim 1 wherein said first finishing agent is applied as a foamed printing composition by means of a rotary screen printer or intaglio printing cylinder.

13. The process according to claim 1 wherein said first finishing agent is applied as a foamed printing composition to a pile substrate.

14. A process for dyeing textile materials which comprises the steps of:

(a) preparing a foamed dye containing composition which includes a reactive material therein;

(b) applying said foamed dye containing composition to said textile material;

(c) collapsing said foamed dye containing composition;

(d) preparing a second foamed composition containing therein a material suitable to interact with said reactive material in said foamed dye containing composition;

(e) coating said textile material containing said foamed dye containing composition with said second foamed composition, said second composition being coated over said foamed dye containing composition prior to fixation of said foamed dye containing composition;

(f) collapsing said second foamed composition so as to achieve penetration of said dye into said textile material;

(g) allowing said reactive material in said foamed dye containing material to interact with the material in said second foamed composition; and (h) thereafter drying and fixing the dye in said textile material.

15. The process according to claim 14 wherein said foamed dye containing composition includes a reactive dye material therein and is applied to a cellulosic fabric and said second foamed composition is alkaline so as to develop said reactive dye material.

16. A process for dyeing textile materials which comprises the steps of:

(a) preparing a dye containing composition which includes a reactive material therein;

(b) applying said dye containing composition to said textile material;

(c) preparing a foamed composition containing therein a material suitable to interact with said reactive material in said dye containing composition;

(d) coating said textile material containing said dye containing composition with said foamed composition, said foamed composition being coated over said dye containing composition prior to fixation of said dye containing composition;

(e) collapsing said foamed composition so as to achieve penetration of said dye into said textile material;

(f) allowing said reactive material in said dye containing material to interact with the material in said foamed composition; and (g) thereafter drying and fixing the dye in said textile material.

17. The process according to claim 16 wherein said dye containing composition includes a reactive dye material therein and is applied to a cellulosic fabric and said foamed composition is alkaline so as to develop said reactive dye material.

* * * * *